US009596905B2

(12) United States Patent
Polegato Moretti

(10) Patent No.: US 9,596,905 B2
(45) Date of Patent: Mar. 21, 2017

(54) MIDSOLE STRUCTURE, PARTICULARLY FOR SHOES, INCLUDING SHOES WITH A VAPOR-PERMEABLE SOLE, DESIGNED FOR USE IN SPORTS ACTIVITIES

(75) Inventor: Mario Polegato Moretti, Crocetta Del Montello (IT)

(73) Assignee: GEOX S.p.A., Montebelluna (IT)

( * ) Notice: Subject to any disclaimer, the term of this patent is extended or adjusted under 35 U.S.C. 154(b) by 38 days.

(21) Appl. No.: 13/264,999

(22) PCT Filed: Apr. 13, 2010

(86) PCT No.: PCT/EP2010/054796
§ 371 (c)(1),
(2), (4) Date: Oct. 18, 2011

(87) PCT Pub. No.: WO2010/130515
PCT Pub. Date: Nov. 18, 2010

(65) Prior Publication Data

US 2012/0036741 A1 Feb. 16, 2012

(30) Foreign Application Priority Data

May 13, 2009 (EP) ..... 09425183

(51) Int. Cl.
*A43B 7/06* (2006.01)
*A43B 7/08* (2006.01)
(Continued)

(52) U.S. Cl.
CPC ..... *A43B 7/08* (2013.01); *A43B 7/087* (2013.01); *A43B 7/125* (2013.01); *A43B 13/125* (2013.01)

(58) Field of Classification Search
CPC ..... A43B 7/08; A43B 7/084; A43B 7/087; A43B 7/081; A43B 7/082; A43B 5/08; A43B 7/12; A43B 7/1405; A43B 7/1485
(Continued)

(56) References Cited

U.S. PATENT DOCUMENTS 3,050,875 A * 8/1962 Robbins ..... A43B 7/06 36/3 B
5,588,226 A 12/1996 Schenkel
(Continued)

FOREIGN PATENT DOCUMENTS

| | | |
|---|---|---|
| FR | 2 915 854 | 11/2008 |
| WO | 2004 028284 | 4/2004 |
| WO | 2005 011417 | 2/2005 |

OTHER PUBLICATIONS

International Search Report issued Jul. 19, 2010 in PCT/EP10/054796 filed Apr. 13, 2010.
(Continued)

*Primary Examiner* — Khoa Huynh
*Assistant Examiner* — Katharine Gracz
(74) *Attorney, Agent, or Firm* — Oblon, McClelland, Maier & Neustadt, L.L.P.

(57) ABSTRACT

A midsole structure for shoes, including shoes with a vapor-permeable sole, designed for use in sports activities, comprising a monolithic plantar frame made of polymeric material, which comprises a reinforced rim with structural cross-members, which cooperate to delimit opening compartments that pass through the monolithic plantar frame in order to lead onto opposite faces thereof, at least one first vapor-permeable element, which covers at least the opening compartments, which open onto a first one of the faces, with which the first vapor-permeable element is associated, at least one second vapor-permeable element, which covers at
(Continued)

least the opening compartments, which open onto the second one of the faces, with which the second vapor-permeable element is associated.

17 Claims, 3 Drawing Sheets

(51) Int. Cl.
*A43B 7/12* (2006.01)
*A43B 13/12* (2006.01)

(58) Field of Classification Search
USPC .... 36/14, 3 B, 3 R, 30 R, 25 R, 29, 31, 102, 36/22 A, 8.1
See application file for complete search history.

(56) References Cited

U.S. PATENT DOCUMENTS 5,595,002 A 1/1997 Slepian et al.
6,321,469 B1 * 11/2001 Cretinon ..... A43B 13/10 36/102
6,508,015 B1 * 1/2003 Rauch ..... 36/3 B
6,681,500 B2 * 1/2004 Moretti ..... 36/3 B
6,839,984 B2 * 1/2005 Polegato ..... 36/3 B
7,013,581 B2 * 3/2006 Greene ..... A43B 7/08 36/114
7,096,604 B2 8/2006 Polegato Moretti
7,337,557 B2 * 3/2008 Miyata ..... 36/3 B
7,367,141 B2 * 5/2008 Polegato Moretti ..... 36/3 B
2002/0050075 A1 * 5/2002 Moretti ..... 36/3 R
2002/0184791 A1 * 12/2002 Ko ..... A43B 3/105 36/8.1
2005/0172513 A1 * 8/2005 Lechhart et al. ..... 36/3 B
2006/0162183 A1 7/2006 Polegato Moretti
2007/0011907 A1 1/2007 Polegato Moretti
2008/0052966 A1 * 3/2008 Pan ..... A43B 3/108 36/3 B
2008/0209769 A1 9/2008 Polegato Moretti
2010/0024255 A1 2/2010 Oumnia
2012/0017470 A1 * 1/2012 Pan ..... A43B 3/108 36/103

OTHER PUBLICATIONS

European Search Report issued Oct. 5, 2009 in EP 09425183 filed May 13, 2009.

* cited by examiner

MIDSOLE STRUCTURE, PARTICULARLY FOR SHOES, INCLUDING SHOES WITH A VAPOR-PERMEABLE SOLE, DESIGNED FOR USE IN SPORTS ACTIVITIES

TECHNICAL FIELD

The present invention relates to a midsole structure particularly for shoes, including shoes with a vapor-permeable sole, designed for use in sports activities.

BACKGROUND ART

Currently, in the field of shoes, including shoes with a vapor-permeable sole, designed for use in sports activities, the need is felt to propose shoes that can cushion the impacts of the foot with the ground and optionally return elastically part of the energy of this impact.

Soles and midsoles are known which, in order to meet this requirement, comprise a thickness of elastically yielding and shock-absorbing material, which is adapted to self-shape anatomically according to the configurations that the foot of the user assumes during its movement.

Together with conformability, another characteristic that these midsoles are designed to have consists in effective capability to cushion the impacts of the foot with the ground.

Currently known midsoles, in order to meet the need to have such features, are generally made of polymeric material, particularly expanded polyurethane, PU, or ethyl vinyl acetate, EVA.

Soles and midsoles are also known which have, at the heel region, shock-absorbing devices that comprise a bubble made of plastic material that contains air or a gel, which is adapted to deform, absorbing partly elastically and partly plastically the energy of the impact with the ground.

Other types of known midsoles comprise a spring constituted by a lamina made of plastic material, which is contoured so as to have an undulated profile and is adapted to flatten upon compression of the midsole during its deformation upon impact with the ground, in order to cushion its impact, returning, as an elastic response, part of the deformation energy.

It is also known that particularly during physical efforts during sports activity, perspiration of the body and also of the foot becomes more intense.

In most currently known sports shoes, moisture produced by perspiration generated by the sole of the foot does not find easy dissipation paths and therefore soaks the insole, generally causing a feeling of discomfort to the user.

DISCLOSURE OF THE INVENTION

The aim of the present invention is to provide a midsole structure that allows to generate ventilation of the sole of the foot.

Within this aim, an object of the invention is to devise a midsole structure that is lightweight and flexible in order to conform easily to the movements of the foot of the user.

Another object of the invention is to provide a midsole structure that allows effective cushioning of the impacts of the foot of the user particularly with the ground.

Still another object of the invention is to propose a midsole structure that allows easy vapor permeation of the sole of the foot of the user through said midsole.

Another object of the invention is to provide a midsole structure that is simple and easy to use and can be manufactured at low costs.

This aim, as well as these and other objects that will become better apparent hereinafter, are achieved by a midsole structure, particularly for shoes, including shoes with a vapor-permeable sole, designed for use in sports activities, characterized in that it comprises

- a plantar frame made of polymeric material, which comprises a reinforced rim with structural cross-members, said rim and said structural cross-members cooperating to delimit opening compartments that pass through said frame in order to lead onto opposite faces thereof,
- at least one first vapor-permeable element, which covers at least said opening compartments, which open onto a first one of said faces, with which said first vapor-permeable element is associated,
- at least one second vapor-permeable element, which covers at least said opening compartments, which open onto the second one of said faces, with which said second vapor-permeable element is associated.

BRIEF DESCRIPTION OF THE DRAWINGS

Further characteristics and advantages of the invention will become better apparent from the description of preferred but not exclusive embodiments of the midsole structure according to the invention, illustrated by way of non-limiting example in the accompanying drawings, wherein.

Figure 1:
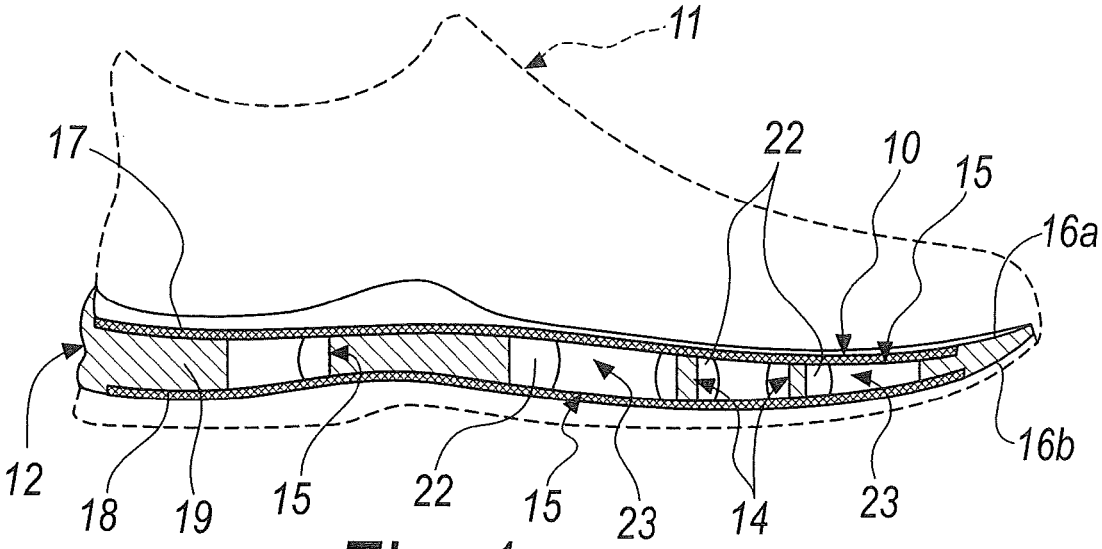
FIG. 1 is a longitudinal sectional view of a midsole structure according to the invention.
Figure 2:
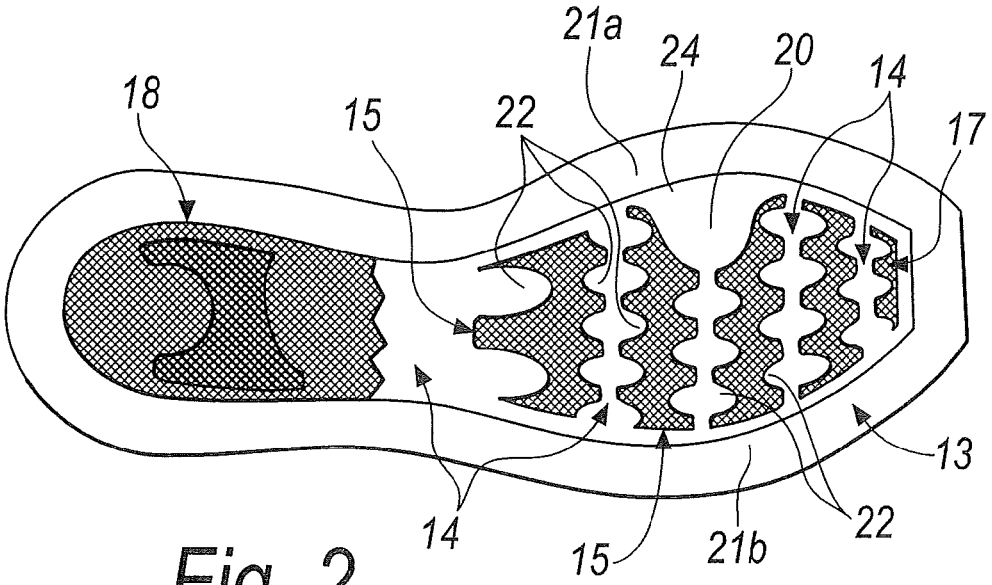
FIG. 2 is a partially sectional top plan view of a midsole structure according to the invention.
Figure 3:
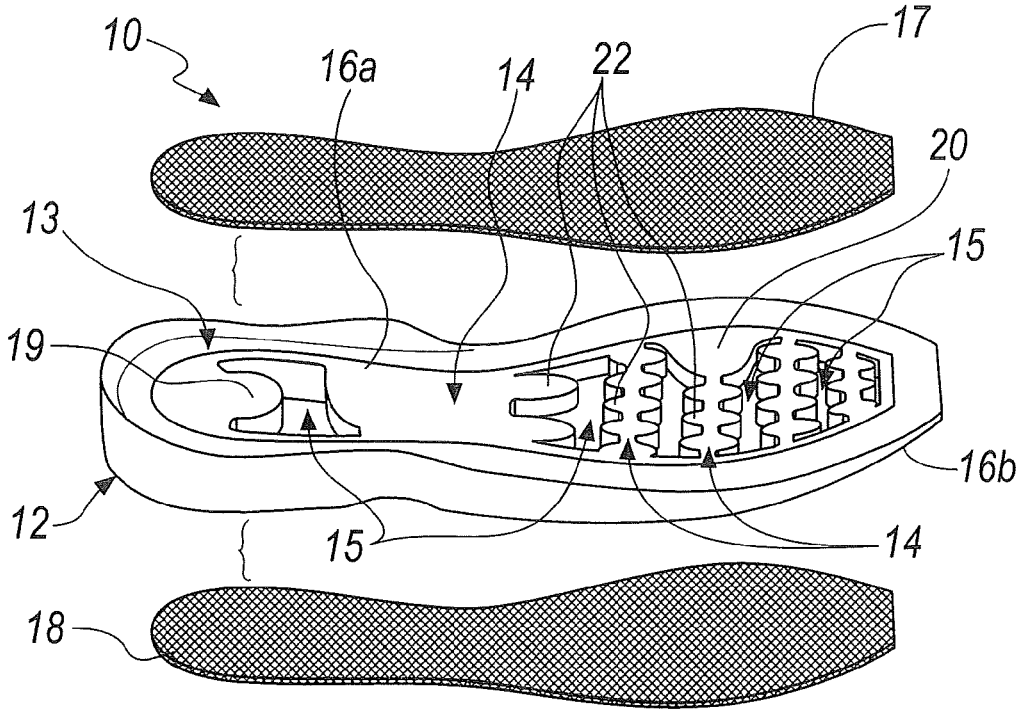
FIG. 3 is an exploded perspective view of a midsole structure according to the invention.

It is noted that anything found to be already known during the patenting process is understood not to be claimed and to be the subject of a disclaimer.

WAYS OF CARRYING OUT THE INVENTION

With reference to the figures, reference numeral 10 generally designates a midsole structure, particularly for shoes 11, including shoes with a vapor-permeable sole, designed for use in sports activities, which has a peculiarity in that it comprises

- a monolithic plantar frame 12 made of polymeric material, conveniently made of ethyl vinyl acetate or expanded polyurethane, which comprises a rim 13 that is reinforced with structural cross-members 14, the rim 13 and the structural cross-members 14 cooperating to delimit opening compartments 15 that pass through the monolithic plantar frame 12 in order to lead onto opposite faces 16*a* and 16*b* thereof,
- a first vapor-permeable element 17, which covers the opening compartments 15, which open onto a first one 16*a* of the faces 16*a* and 16*b*, with which the first vapor-permeable element 17 is associated,
- a second vapor-permeable element 18, which covers the opening compartments 15, which open onto the second one 16*b* of the faces 16*a* and 16*b*, with which the second vapor-permeable element 18 is associated.

In a substantially equivalent manner, alternative embodiments of the midsole structure according to the invention provide for a plurality of first and second vapor-permeable elements, each covering one or more of the opening compartments that open onto the faces of the monolithic plantar frame.

Advantageously, the first vapor-permeable element 17 and the second vapor-permeable element 18 are made of three-dimensional fabric, or in an equivalent manner comprise a layer thereof.

Said three-dimensional fabric is preferably made of polypropylene, polyamide, polyester or equivalents.

More particularly, said vapor-permeable elements 17 and 18 are conveniently shaped like an inner sole and are associated peripherally with the monolithic plantar frame 12 by means of glue or, as an alternative, by overmolding thereon the monolithic plantar frame 12.

Figure 5:
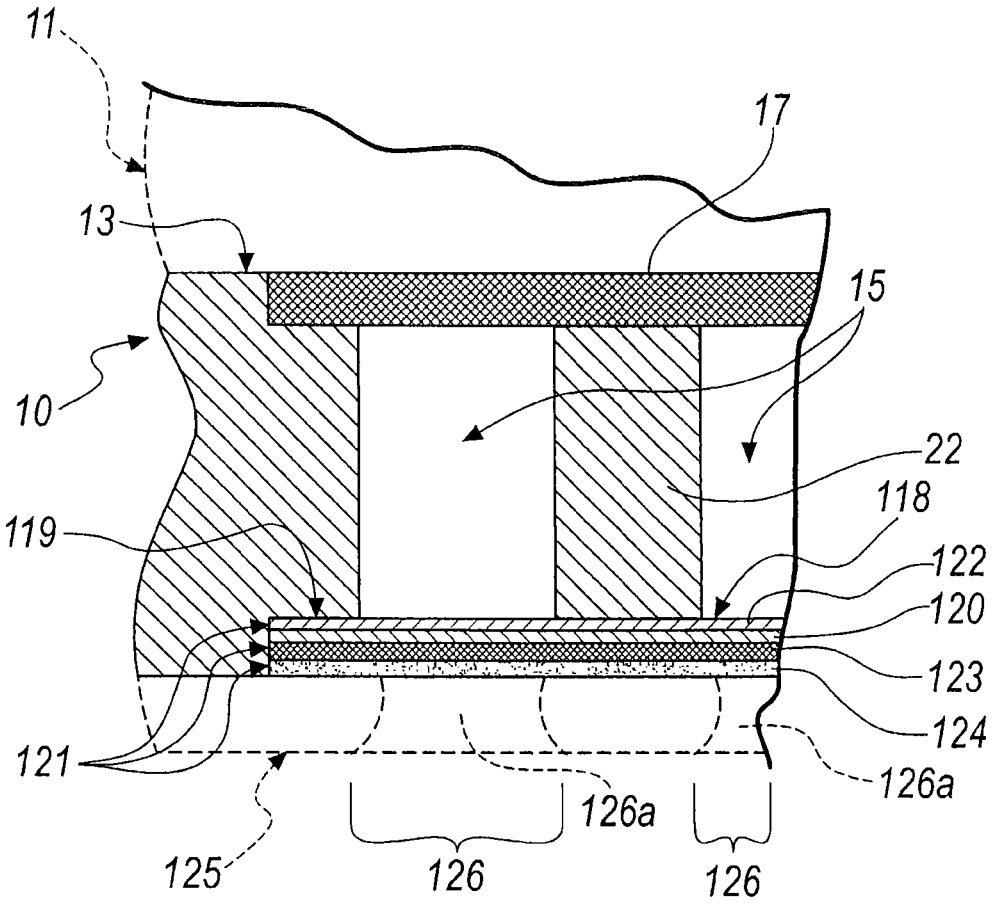
FIG. 5 is an enlarged-scale sectional view of a detail of an alternative embodiment of a midsole structure according to the invention.

In a constructive variation of the midsole structure 10, according to the invention, illustrated by way of non-limiting example in FIG. 5, the second vapor-permeable element 18, which conveniently is designed to face the sole of the shoe provided with the midsole structure 10, comprises a waterproof and vapor-permeable layer 118, i.e., a layer that is impermeable to water in the liquid state and permeable to water vapor.

Said waterproof and vapor-permeable layer 118 is conveniently connected, by means of a waterproof sealing region 119, to the monolithic plantar frame 12 so as to provide tightness to the passage of water in the liquid state and simultaneous permeability to water vapor of the midsole structure 10.

Conveniently, the waterproof sealing region 119 is provided by hermetic adhesive bonding or, as an alternative, by overmolding of the monolithic plantar frame 12 on the waterproof and vapor-permeable layer 118 of the vapor-permeable element 18.

Preferably, the waterproof and vapor-permeable layer 118 comprises a membrane 120 made of polymeric material, conveniently expanded polytetrafluoroethylene, expanded polyurethane or the like.

Moreover, auxiliary layers 121 for protecting and reinforcing the membrane 120 are appropriately provided and conveniently comprise

- a mesh 122 made of synthetic material, for example Nylon®, which is associated with the membrane 120,
- a protective layer 123, which is associated in a downward region with respect to the membrane 120, in order to protect it against impacts, cuts and perforations and is preferably made of vapor-permeable material, such as felt, Kevlar®, or other strong and diffusely perforated material,
- a supporting layer 124, which is associated in a downward region with respect to the protective layer 123 and is made of a dense-knitted mesh of metallic material, synthetic material or natural fibers.

Advantageously, the use of a midsole structure 10 according to the invention in said constructive variation entails that it is associated with a perforated sole 125 which has, below said opening compartments 15, vapor permeation regions 126, which are conveniently affected by a number of diffuse holes or by large openings 126*a* which are adapted to allow the dispersion of the water vapor that arrives from the foot insertion region.

In alternative embodiments of the midsole structure according to the invention, the first vapor-permeable element also comprises a waterproof and vapor-permeable membrane as described.

In this case, it is conveniently reinforced by a mesh made of Nylon or other synthetic material, the described protective layer and supporting layer being optionally provided as well, if the technical and operating characteristics of the particular embodiment of the midsole structure, according to the invention, require their presence to reinforce and protect the membrane.

Likewise, in an alternative embodiment of a midsole structure according to the invention the first vapor-permeable element comprises a waterproof and vapor-permeable membrane, as described, and at the same time the second vapor-permeable element is made of three-dimensional fabric or comprises a layer thereof.

Advantageously, the monolithic plantar frame 12 has a first reinforcement 19 for bearing the heel of the user.

Said first reinforcement 19 extends substantially along the entire thickness that the rim 13 has at the heel of the shoe, so as to form, in cooperation with the rim, the support for the heel of the user.

The monolithic plantar frame 12 conveniently has a second reinforcement 20 for bearing the first metatarsophalangeal articulation of the user, which extends substantially through the entire thickness that the rim 13 has at the forepart of the midsole structure 10.

In this manner, the second reinforcement 20 cooperates with the rim 13 in defining a support for one of the main resting regions of the foot of the user, which, as it is known, corresponds to the first metatarsophalangeal articulation.

Conveniently, the structural cross-members 14 join transversely opposite portions 21*a* and 21*b* of the rim 13, and have, with respect to them, a substantially identical thickness, so as to share with them the load applied by the user to the midsole structure 10.

Moreover, the structural cross-members 14 have extensions 22 that lie transversely with respect to their length and are conveniently lobe-shaped and adapted to distribute the load applied by the user on the midsole structure 10 during the use of a shoe 11 that comprises it.

The first vapor-permeable element 17 and the second vapor-permeable element 18 form advantageously, through themselves, a ventilation path that is substantially longitudinal with respect to the midsole structure 10.

The opening compartments 15, enclosed by the first vapor-permeable element 17 and the second vapor-permeable element 18, form ventilation plenums 23 of the midsole structure 10.

During the use of a shoe that comprises a midsole that has the structure 10, the pressure of the foot of the user thereon causes the substantially elastic deformation of the monolithic plantar frame 12 thereof.

Figure 4:
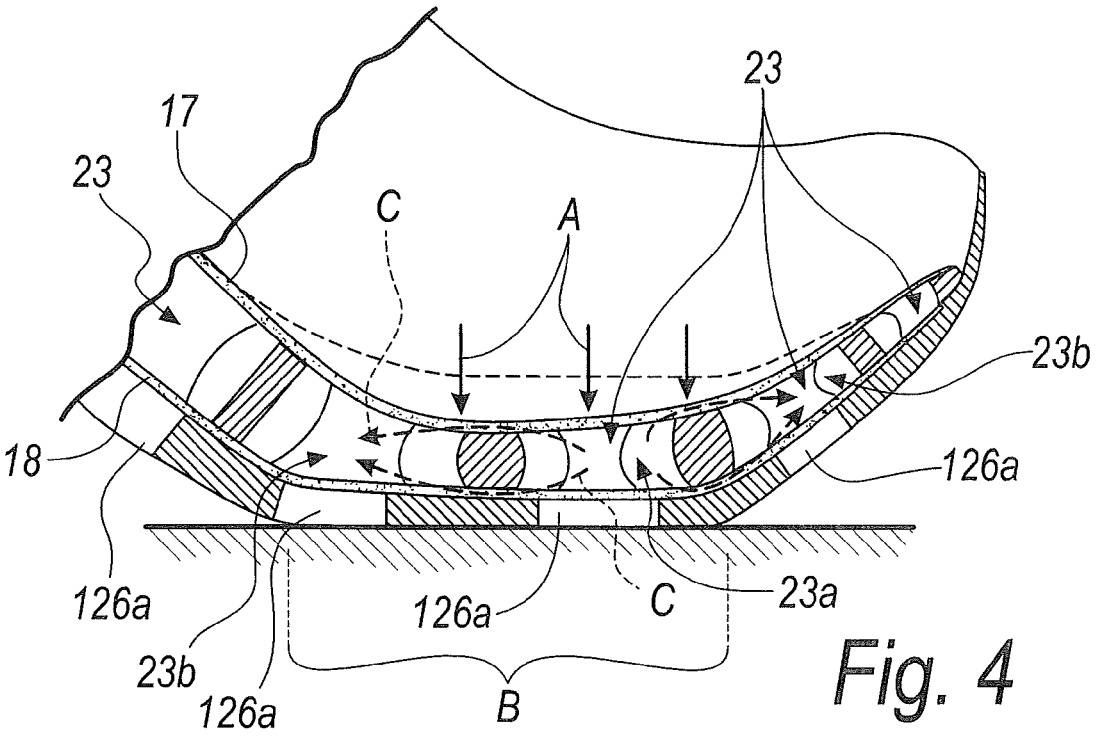
FIG. 4 is a partially sectional enlarged-scale view of a detail of a midsole structure according to the invention, in a configuration for use.

With particular reference to FIG. 4, for example, the stresses A generated on the monolithic plantar frame 12 by the foot of the user cause the successive contraction of the ventilation plenums 23 that correspond to the portion B of the shoe 11, which constitutes the bearing of the foot of the user on the ground.

At said portion B, on which the weight of the user is concentrated during physical activity, the deformation of the monolithic plantar frame 12 produces a compression of the corresponding rim portion 13 and of the structural cross-members 14 at right angles to the resting plane of the portion B and an expansion thereof transversely to said resting plane.

Such deformations define a contraction of at least a first one 23*a* of the ventilation plenums 23, which is located at the portion B.

This contraction imparts to the air contained in said first plenum 23*a* an evacuation pressure that causes its passage C through at least one between the first vapor-permeable element 17 and the second vapor-permeable element 18, toward second plenums 23*b* that are adjacent to the first plenum 23*a*.

Advantageously, the first vapor-permeable element 17 and the second vapor-permeable element 18 are connected at least peripherally to the rim 13, conveniently by adhesive bonding, and said rim has, on the faces 16*a* and 16*b*, corresponding peripheral regions 24 for connection to the vapor-permeable elements 17 and 18.

In practice it has been found that the invention achieves the intended aim and objects, providing a midsole structure that allows to generate ventilation of the sole of the foot, at the same time ensuring effective cushioning of the impacts of the foot of the user, in particular with the ground, thanks to the elastic deformability of the monolithic plantar frame.

Moreover, a midsole structure according to the invention, being made mainly of microporous ethyl vinyl acetate or expanded polyurethane, is lightweight and flexible and adapted to conform easily to the movements of the foot of the user.

The invention thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to requirements and to the state of the art.

The disclosures in European Patent Application No. 09425183.2 from which this application claims priority are incorporated herein by reference.

The invention claimed is:

1. A midsole structure, particularly for shoes, including shoes with a vapor-permeable sole, designed for use in sports activities, comprising:

a monolithic plantar frame made of polymeric material, which comprises a reinforced rim with structural cross-members, said rim and said structural cross-members cooperating to delimit opening compartments that pass through said monolithic plantar frame in order to lead onto opposite faces of the plantar frame;

at least one first vapor-permeable element that covers at least said opening compartments, which open onto a first one of said faces, the first vapor-permeable element being secured to the first one of the faces; and at least one second vapor-permeable element that covers at least said opening compartments, which open onto the second one of said faces, the second vapor-permeable element being secured to the second one of the faces, wherein the midsole structure is configured to be secured to a perforated sole which has, below said opening compartments, vapor permeation regions;

wherein said structural cross-members and opening compartments extend continuously across so as to join transversely opposite portions of said rim;

wherein said structural cross-members include extensions, arranged transversely to their length, that are adapted to distribute the load applied by the user on said midsole structure during use of a shoe that comprises the structural cross-members; and wherein the extensions are lobe shape.

2. The midsole structure according to claim 1, wherein at least one of said vapor-permeable elements comprises a layer of three-dimensional fabric.

3. The midsole structure according to claim 1, wherein at least one of said vapor-permeable elements comprises a waterproof and vapor-permeable layer, which is connected by way of a waterproof sealing region to said monolithic plantar frame, so as to provide tightness to the passage of water in the liquid state and simultaneous permeability to water vapor of said midsole structure.

4. The midsole structure according to claim 3, wherein said waterproof and vapor-permeable layer comprises a membrane made of polymeric material that is impermeable to water in the liquid state and permeable to water vapor.

5. The midsole structure according to claim 4, wherein said polymeric material that is impermeable to water in the liquid state and permeable to water vapor, is selected among expanded polytetrafluoroethylene and expanded polyurethane.

6. The midsole structure according to claim 4, wherein said monolithic plantar frame has a first reinforcement adapted for bearing a heel of a user, said first reinforcement being extended substantially through the entire thickness that said rim has at the heel of the shoe.

7. The midsole structure according to claim 6, wherein said monolithic plantar frame has a second reinforcement adapted for a first metatarsophalangeal articulation of the user, said second reinforcement being extended substantially through the entire thickness that said rim has at a forepart of the midsole structure.

8. The midsole structure according to claim 1, wherein said structural cross-members have, with respect to the transversely opposite portions, a substantially identical thickness.

9. The midsole structure according to claim 1, wherein said first vapor-permeable element and said second vapor-permeable element form through themselves a ventilation path that is substantially longitudinal with respect to said midsole structure.

10. The midsole structure according to claim 1, wherein said opening compartments, enclosed by said first vapor-permeable element and said second vapor-permeable element, form ventilation plenums of said midsole structure.

11. The midsole structure according to claim 1, wherein said first vapor-permeable element and said second vapor-permeable element are connected at least peripherally to said reinforced rim, which has, on said faces, corresponding peripheral regions for connection to said vapor-permeable elements.

12. The midsole structure according to claim 1, wherein said first vapor-permeable element and said second vapor-permeable element are connected to said rim by adhesive bonding.

13. The midsole structure according to claim 1, wherein said monolithic plantar frame is made of ethyl vinyl acetate.

14. The midsole structure according to claim 1, wherein said monolithic plantar frame is made of expanded polyurethane.

15. The midsole structure according to claim 2, wherein said three-dimensional fabric is made of a material selected among polypropylene, polyamide and polyester.

16. The midsole structure according to claim 4, further comprising auxiliary layers for protecting and reinforcing the membrane.

17. The midsole structure according to claim 16, wherein the auxiliary layers include a mesh associated with a first side of the membrane, a protective layer associated with a second side of the membrane opposite the first side, and a supporting layer associated with the protective layer on a side of the protective layer opposite to the membrane.

* * * * *